US007152267B2

(12) United States Patent
Kaleta

(10) Patent No.: US 7,152,267 B2
(45) Date of Patent: Dec. 26, 2006

(54) FLOOR SWEEPER

(76) Inventor: Bryan Kaleta, 1037 Hinswood Dr., Darien, IL (US) 60561

( * ) Notice: Subject to any disclaimer, the term of this patent is extended or adjusted under 35 U.S.C. 154(b) by 314 days.

(21) Appl. No.: 10/861,705

(22) Filed: Jun. 3, 2004

(65) Prior Publication Data

US 2005/0005377 A1 Jan. 13, 2005

Related U.S. Application Data

(60) Provisional application No. 60/506,365, filed on Sep. 25, 2003.

(51) Int. Cl.
*A47L 11/24* (2006.01)

(52) U.S. Cl. ..... 15/42; 15/41.1; 15/52.1

(58) Field of Classification Search ..... 15/41.1, 15/42, 52.1
See application file for complete search history.

(56) References Cited

U.S. PATENT DOCUMENTS

| | | | | |
|---|---|---|---|---|
| 271,284 | A | 1/1883 | Snook | |
| 436,689 | A | 9/1890 | Boggs | |
| 471,515 | A * | 3/1892 | Tangenberg | 15/42 |
| 601,628 | A | 4/1898 | Browne | |
| 631,837 | A | 8/1899 | Wilkins | |
| 801,882 | A | 10/1905 | Knell | |
| 865,084 | A | 9/1907 | Deitch et al. | |
| 866,640 | A | 9/1907 | Friedman | |
| 1,319,836 | A | 10/1919 | Boyle | |
| 1,972,870 | A | 9/1934 | Christesen | |
| 2,206,429 | A | 7/1940 | Redfearn | |
| 2,235,432 | A | 3/1941 | Kenyon | |
| 2,396,861 | A | 3/1946 | Linderoth | |
| 2,403,105 | A * | 7/1946 | Torvald | 15/41.1 |
| 2,502,403 | A | 3/1950 | Kircher | |
| 2,536,902 | A | 1/1951 | Beckett | |
| 2,968,055 | A * | 1/1961 | Torvald | 15/41.1 |
| 3,159,860 | A | 12/1964 | Colver | |
| 3,319,278 | A | 5/1967 | Frazer | |
| 3,638,266 | A | 2/1972 | Fukuba | |
| 3,744,077 | A | 7/1973 | Smyth | |
| 3,748,679 | A | 7/1973 | Rosendall | |
| 3,978,539 | A | 9/1976 | Yonkers | |
| 4,099,284 | A | 7/1978 | Shinozaki et al. | |
| 4,168,561 | A | 9/1979 | Rosendall | |
| 4,263,689 | A | 4/1981 | Leibscher et al. | |
| 4,357,727 | A | 11/1982 | McDowell | |
| 4,502,173 | A | 3/1985 | Pätzold et al. | |
| 5,933,900 | A * | 8/1999 | Wang | 15/50.3 |

* cited by examiner

*Primary Examiner*—Mark Spisich
(74) *Attorney, Agent, or Firm*—Knechtel, Demeur & Samlan

(57) ABSTRACT

A light weight floor sweeper having a very low profile sweeper head that uses glides rather than rollers to slide across the surface to be cleaned. The floor sweeper head is mounted to an elongated handle by a universal pivot or universal joint which allows the floor sweeper head to easily pivot about the handle in any direction to pick up debris under over hanging cabinets or under furniture. The floor sweeper has sweeping brushes mounted around all sides of the sweeper head to provide sweeping action in any direction. Furthermore there are corner brushes extending out from the sides of the sweeper head that reach into corners to sweep debris toward the main sweeping brushes. All of the brushes are powered by a small electric motor. The motor drives the brushes to direct the debris into a dust-receiving tray in the sweeper head.

39 Claims, 4 Drawing Sheets

FLOOR SWEEPER

CROSS-REFERENCE TO RELATED APPLICATIONS

This application is based on and claims priority of provisional patent application 60/506,365 filed Sep. 25, 2003.

BACKGROUND AND SUMMARY OF THE INVENTION

This invention relates to handheld floor sweepers and more particularly to a hand held floor sweeper having a plurality of sweeping brushes powered by an electric motor.

Handheld sweepers have been used in the past to pick up dust and small items from hard surfaces, such as wood or tile floors, and carpets having varying piles of various height. One type of handheld floor sweeper that has been used extensively in the past is a manually pushed floor sweeper that is not powered by a motor. The handheld sweeper has brushes mounted on a shaft located in the sweeper head that contact the surface to be cleaned. The brushes rotate as the sweeper is pushed and pulled across the floor surface. The brushes rotate and the bristles sweep the loose material up into a dust canister or similar dust-receiving portion in the sweeper head. A problem with this type of floor sweeper is that it only picks up material in the forward or rearward direction as the user pushes or pulls the sweeper across the floor as the sweeper is designed for movement in just the forward or reward directions. The sweeper head does not rotate about its handle for movement in the left or right directions, nor does it easily change directions for cleaning under low overhanging objects such as under cabinets or furniture.

The invention disclosed herein is a new type of floor sweeper, which is extremely light and has a very low profile sweeper head. The floor sweeper head is mounted to an elongated handle by means of a universal pivot or universal joint. This allows the floor sweeper head to easily pivot about the handle in any direction for easily picking up loose materials under over hanging cabinets or under furniture. The floor sweeper also has brushes mounted around all four sides of the sweeper head. This provides cleaning action in any direction, not just in the forward or reverse direction. Furthermore there are brushes extending out from the sides of the sweeper head that reach into corners to sweep debris into the main brushes. All of the brushes are powered by a small electric motor. The motor drives the brushes to direct the dust or loose material into the dust-receiving canister in the sweeper head.

OBJECTS OF THE INVENTION

It is an object of the invention to provide a handheld sweeper that has sweeper brushes along all four sides of the sweeper head to clean a surface regardless of which direction the sweeper is moved.

It is another object to provide a handheld sweeper that has sweeper brushes that are mounted along the side edges of the sweeper head to clean along edges formed by an upstanding wall and floor.

At is still another object to provide a handheld sweeper that has the sweeper brushes and a driving motor mechanically interconnected.

DETAILED DESCRIPTION OF THE PREFERRED EMBODIMENT

Figure 1:
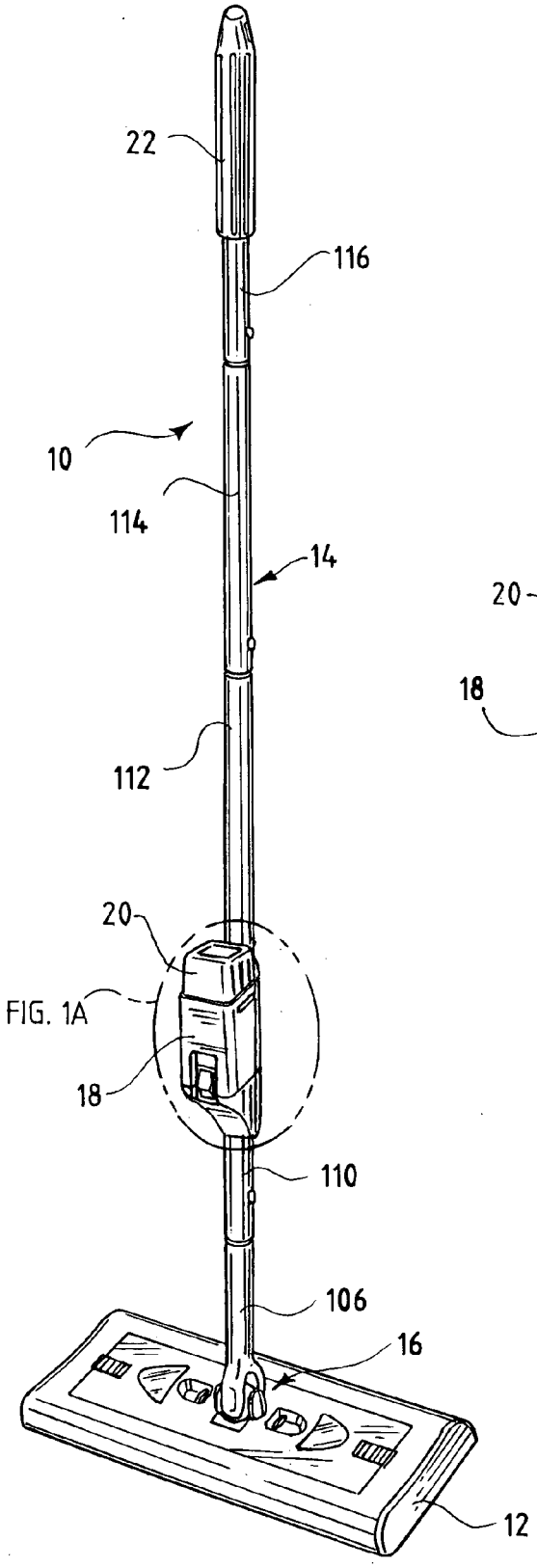
FIG. 1 is a perspective view of the handheld sweeper.
Figure 1A:
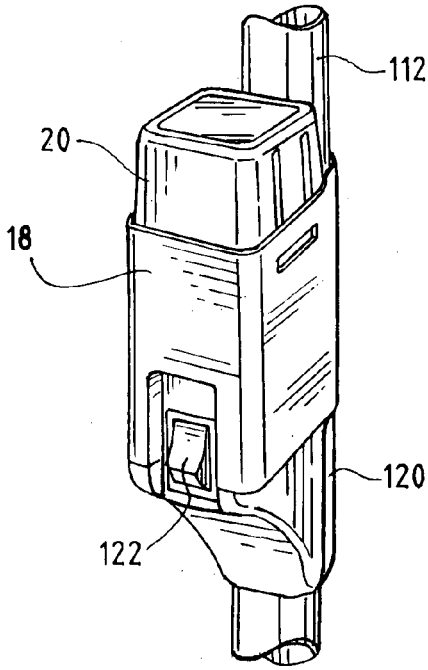
FIG. 1A is an enlarged perspective view of the battery pack shown in the encircled portion on FIG. 1.

Turning first to FIG. 1 a sweeper 10 of the present invention is disclosed. There is a sweeper head 12 connected to an elongated handle 14 by means of a universal pivot 16. Mounted on the elongated handle 14 is a battery box 18 that contains a rechargeable battery 20. At a top end of the elongated handle 14 is a grasping portion 22 which the user holds to push, pull or otherwise move the sweeper 10.

Figure 2:
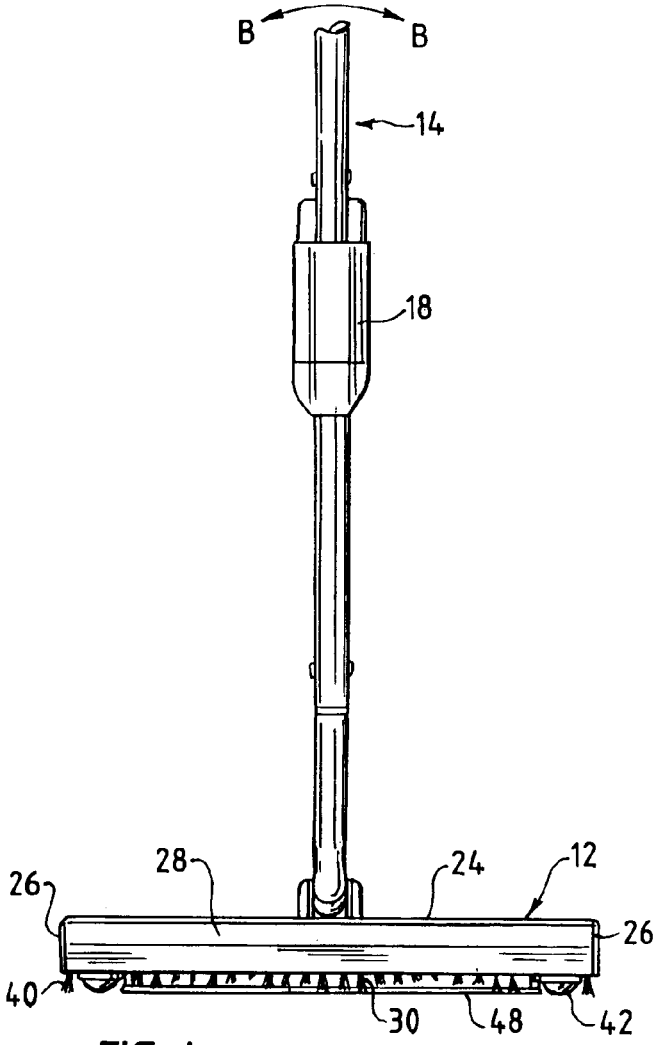
FIG. 2 is a front elevation view with portions removed of the hand sweeper.
Figure 3:
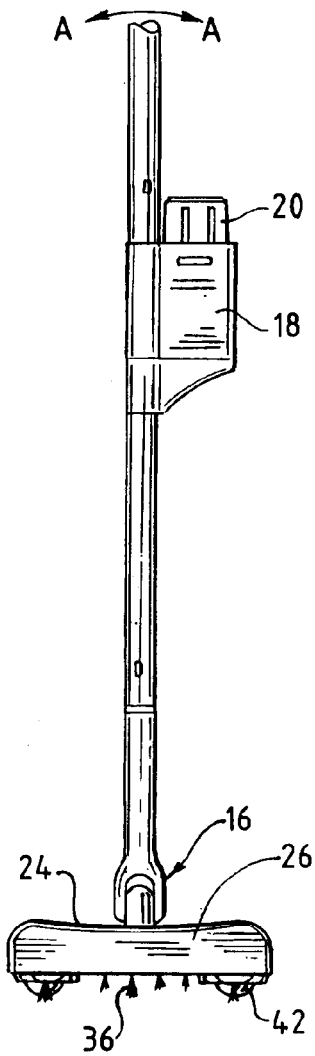
FIG. 3 is a left side view of the sweeper with portions removed.

FIGS. 2 and 3 illustrate the outer design of the sweeper head 12. The sweeper head 12 has a housing comprised of a rectangular top 24, short sides 26 and long sides 28. The universal pivot 16 is attached to the top 24.

Figure 4:
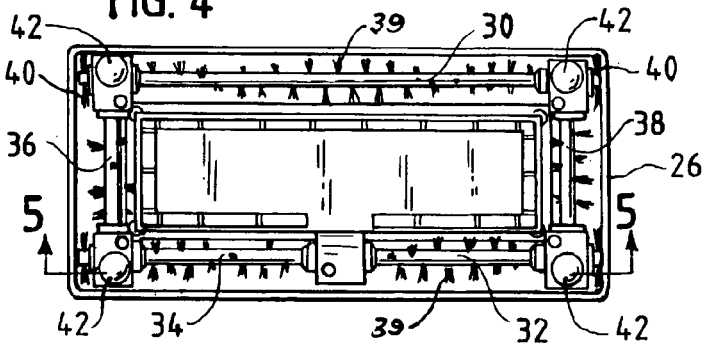
FIG. 4 is a bottom view of the sweeper.

FIG. 4 illustrates the underside of the sweeper head 12. Mounted along one of the long sides 28 at the front of the sweeper head 12 is a long brush 30. Mounted along the other long side 28 at the rear of the sweeper head 12, are a pair of rear brushes 32, 34. Along one of the short sides 26 is a first side brush 36 and along the opposite short side is a second side brush 38. Mounted to or integrally formed in the brushes 30, 32, 34, 36 and 38 are radially extending bristles 39 that are designed to contact the surface to be cleaned and sweep the debris up from the surface.

Corner brushes 40 are mounted with the plane of the bristles substantially parallel to the sides 26 at each of the four corners. However, the bristles of the corner brushes 40 are spread out in the plane parallel to the short side 26 so that the bristles actually extend out beyond the short sides 26. This enables the bristles of the corner brushes 40 to contact and clean a corner formed between the floor and a wall or other upstanding surface. If the bristles do not extend at least under the short sides 26, the short sides 26 contact the wall or other upstanding surface and will not allow the corners to be swept. All of the brushes are mounted on shafts so that the brushes can freely rotate.

The sweeper head 12 slides on high gloss, high polished plastic slides or glides 42 as seen in FIGS. 2–4. These are positioned in each of the four corners of the sweeper head 12 and allow the sweeper head 12 to easily glide over both a hard surface and carpet. Rollers may replace these glides. Furthermore the sweeper head can be easily moved in any direction along the surface to be cleaned, and the arrangement of the rollers along the front, rear and sides result in the sweeping of debris from the surface regardless of the direction of movement.

Figure 6:
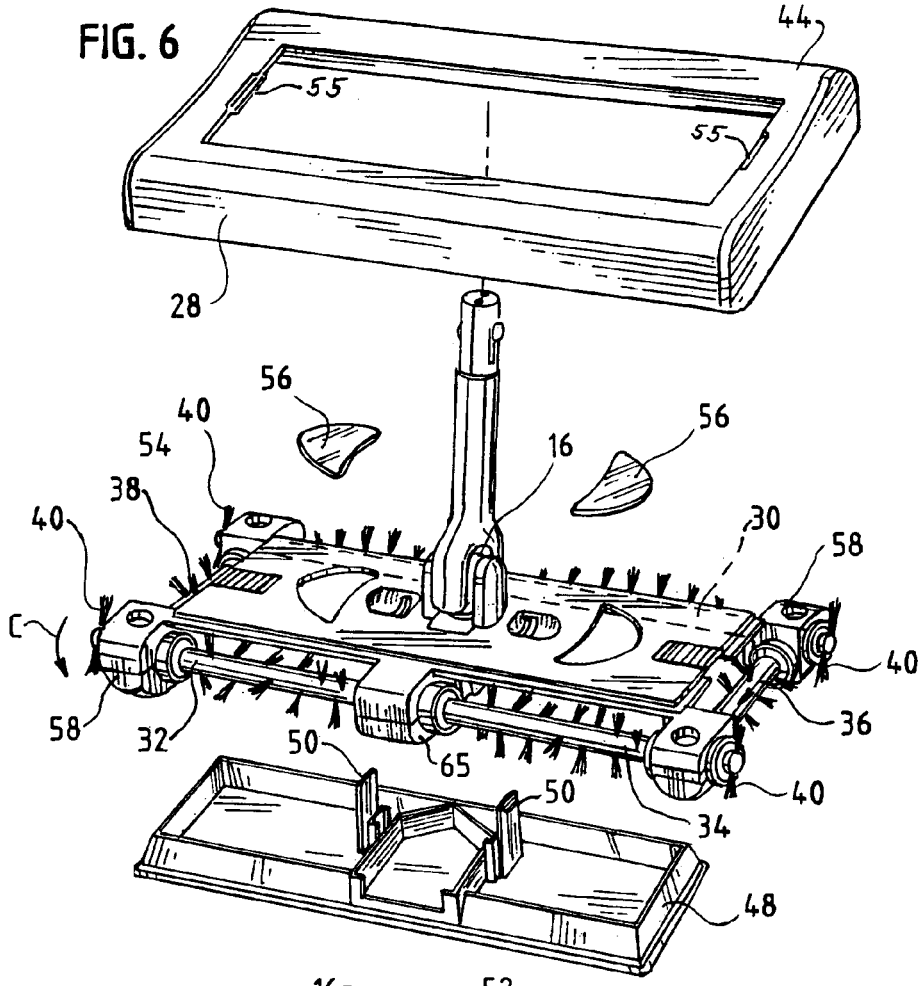
FIG. 6 is a partially exploded view of the sweeper head.
Figure 7:
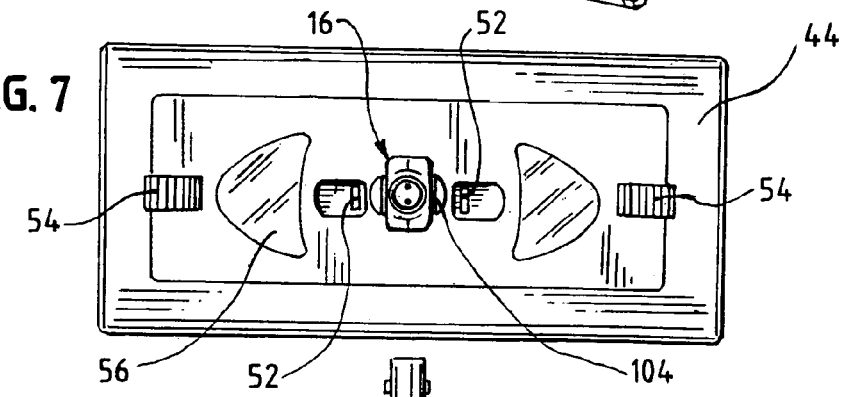
FIG. 7 is a top view of the sweeper head.
Figure 8:
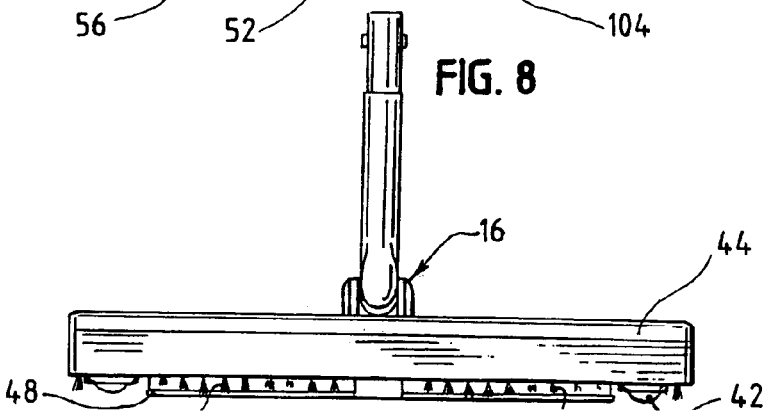
FIG. 8 is a rear view of the sweeper head with the elongated handle removed.

The sweeper head 12 has a top casing 44 as seen in FIG. 6. The brushes are mounted on a chassis 46. The universal pivot 16 is also mounted to the chassis 46. A dust receiving tray 48 is positioned below the chassis 46. Locating and locking tabs 50 extend upwardly from the dust receiving tray 48. These tabs 50 extend through receiving slots 52 in the chassis 46. The slots 52 have locking means to engage and lock the tabs 50 within the slots 52. Sliding tabs 54 on the chassis 46 can slide outward to engage indentations 55 in the top casing 44. In this manner the chassis 46 is placed in locking engagement with the top casing 44. When the dust receiving tray 48 is full and is to be emptied, the tabs 50 are pushed to one side which unlocks them for the slots 52 and the dust receiving tray 48 is released for emptying. Two plastic windows 56 mounted in the top of the chassis 46 allow the user to observe the inside of the dust receiving tray 48 so that it can be emptied when it is full of debris. FIG. 7 illustrates the dust receiving tray 48 and chassis 46 attached to the casing 44.

Figure 9:
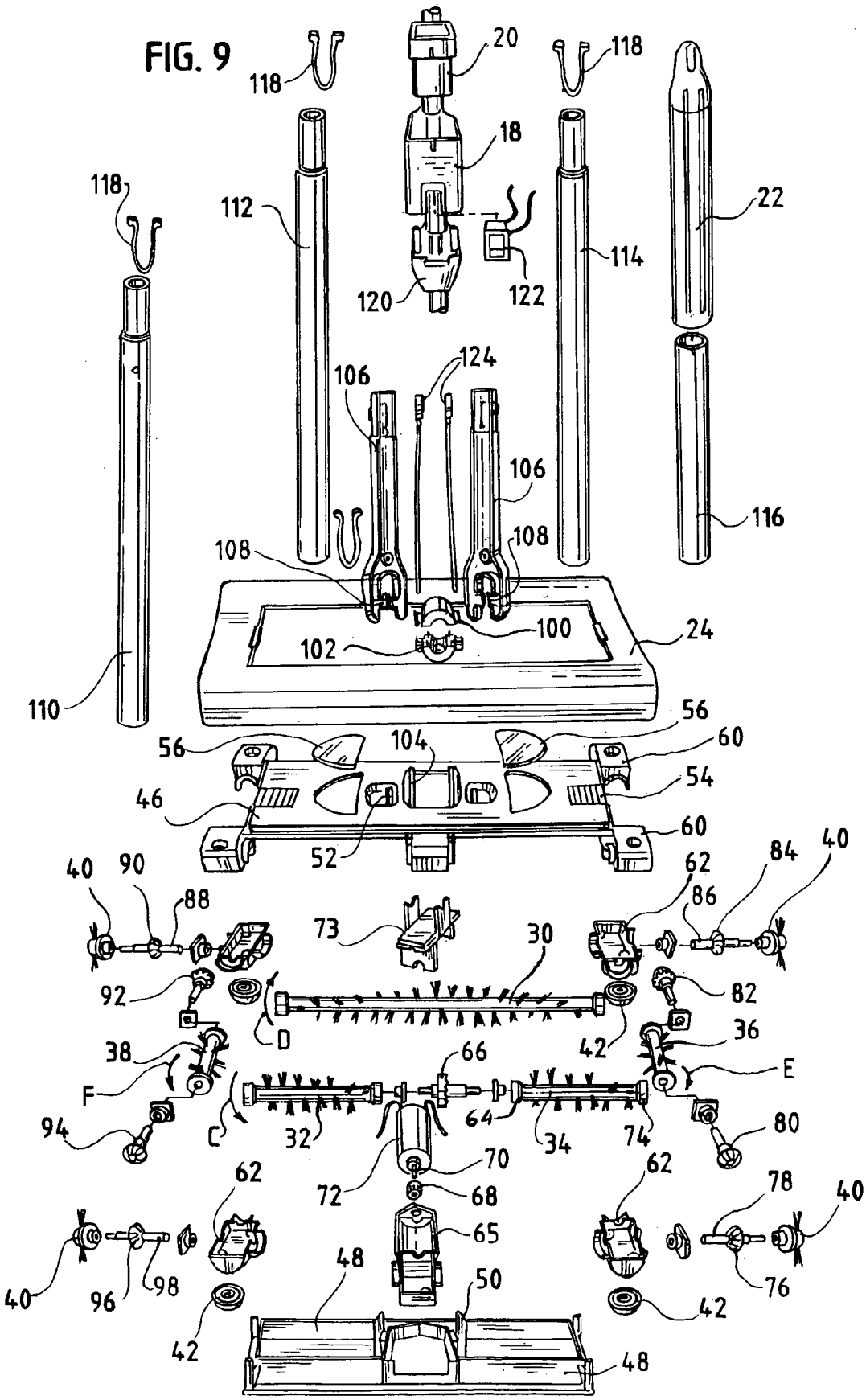
FIG. 9 is a fully exploded view of the sweeper head.

As seen in FIGS. 6 and 9, each of the brushes 30, 32, 34, 36 and 38 is mounted on shafts for rotation. The ends of the brushes are mounted in gear housings 58 comprised of a top housing 60 and a bottom housing 62. The shafts 34, 36, 30, 38 and 32 are mechanically interconnected as described herein. One end 64 of shaft 34 is mounted in a motor housing 65. Gear 66 is mounted on the one end 64 of shaft 34 and is driven by pinion 68 which, in turn, is mounted on drive shaft 70 of a motor 72. The motor 72 is mounted in motor housing 65 and supported by a motor bracket 73. Other end 74 of shaft 34 is mounted in the gear housing 58. Bevel gear 76 mounted on shaft 78 is mounted to other end 74 of shaft 34 within the gear housing 58. Shaft 78 extends out from the gear housing 58 and has a corner brush 40 mounted at its end opposite the other end 74. A complementary bevel gear 80 is mounted on the shaft of first side brush 36, which is an adjacent 90-degree shaft. Similarly bevel gear 82 is mounted at the other end of the shaft. Complementary bevel gear 84 mounted on shaft 86 engages bevel gear 82. These gears are located in a second gear housing 58. Shaft 86 is connected to one end of long brush 30. In a similar arrangement the other end of long brush 30 has shaft 88 connected to it with bevel gear 90 mounted on it. Complementary bevel gear 92 engages bevel gear 90. These gears are located in a third gear housing. Gear 92 in turn is mounted on one end of the second side brush 38. Bevel gear 94 is mounted on the other end of the second side brush 38. Complementary bevel gear 96 is mounted on shaft 98, which in turn is connected to one end of the rear brush 32. These gears are located in a fourth gear housing. The other end of the rear brush 32 is retained within the motor housing 65. This gear arrangement drivingly interconnects brushes 34, 36, 30, 38 and 32 respectively such that all of the brushes rotate in unison.

Figure 5:
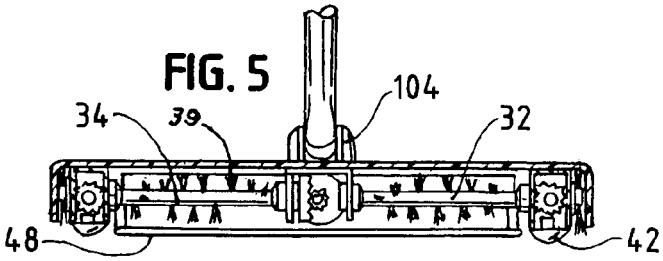
FIG. 5 is a cross sectional view taken along line 5—5 of FIG. 4 showing the sweeper head.

Shafts 78, 86, 88 and 98 have an end that extends out from its respective gear housing 58. Securely mounted on the end of the shaft extending out from the gear housing is a corner brush 40. Thus the corner brushes 40 rotate with the respective rotating long brush or rear brush to which it is connected. The corner brushes spread outward at their tips such that their bristles are under the bottom of the short side 26 of the sweeper head 12. This is seen in FIGS. 2, 4 and 5.

The elongated handle 14 is connected to the sweeper head 12 by means of the universal pivot 16, which is more clearly shown in FIG. 6. The universal pivot connection allows the handle 14 to swivel from the front to the back and from side to side with respect to the sweeper head. This allows the sweeper head to easily rotate in any direction to easily move under furniture, ledges, shelves, etc. The universal pivot 16 is comprised of several components as seen in FIG. 9. There is a pivot ball top 100 and a pivot ball bottom 102 supported by a pivot ball support 104. There are two cross arm yokes 106, which receive the pivot ball top 100 and bottom 102 between the two yokes 106. The pivot ball top and bottom allow the cross arm yokes 106 to rotate on the pivot ball support 104 from one long side 28 to the opposite long side 28. This allows the elongated handle 14 to pivot about the sweeper head 12 as seen by the arrow A—A in FIG. 3.

The yokes 106 have pins 108 at their bottom ends that are rotatably received in the pivot ball top 100 and bottom 102. This provides a pivot point about which the handle 14 can rotate about the sweeper head 12 from one short side 26 to the other short side 26 as illustrated by the arrow B—B of FIG. 2. Other types of universal pivot connections can be utilized as will be apparent to those skilled in the art of mechanical pivot connections. The important point is to allow the handle 14 to freely rotate in all directions about the sweeper head 12. The elongated handle 14 is assembled from a series of interlocking pipes or tubes 110, 112, 114 and 116. Spring loaded pins or locks 118 are placed in one end of each of the tubes 110, 112, and 114, which interlock with receiving holes in the next adjacent tube. One end of each of tubes 110, 112, and 114 has a reduced diameter to receive the end of the next tube above it so that the tube slides over the reduced diameter end.

The rechargeable battery 18 is also mounted on the elongated handle 14 in the battery box 20. The battery box 18 has a removable base 120, which allows access to a switch 122. The switch 122 turns the motor 72 on and off. Electrical wires 124 connect the motor 72 to the battery 20.

The motor 72 and gear drive mechanism cause each of the brushes to rotate in a direction such that the dust or loose material is swept into the sweeper head 12 where it is received in the dust receiving tray 48. For example, as seen in FIG. 9, rear brushes 32 and 34 rotate in the direction of arrow C. Long brush 30 rotates in the opposite direction as illustrated by arrow D. This enables the sweeper 10 to pick up dust or debris when pushed or pulled in either a forward or backward direction.

The first side brush 36 rotates in direction of arrow E and the second side brush 38 rotates in the opposite direction of arrow F. Each of the corner brushes 40 are connected to and driven in the same direction as brushes 30, 32, and 34. As the brushes 40 are mounted at the outer perimeter of the gear housing 58 and under the short sides 26 of the sweeper head top 24, the corner brushes 40 can reach into tight corners and sweep the debris or dust out of the corners where it is directed into one of the first or second side brush 36 or 38. Then the debris is swept by one of the side brushes into the dust-receiving tray 48. In this manner the corner brushes always sweep the debris toward the center of the side brushes where it is swept into the receiving tray 48.

The overall height of the sweeper head 12 including the brushes and glides 42 is maintained as a very low profile sweeper to allow the sweeper to get under cabinets, chairs and low overhangs. The universal pivot 16 allows the sweeper head to easily rotate in any direction for ease in reaching tight spots and permits cleaning the entire floor surface. The battery 20 can be a conventional rechargeable battery that is recharged by plugging into a battery charger. The motor and battery are selected to provide adequate power to the brushes for enough time to perform a normal cleaning operation. All of the components can be easily and inexpensively manufactured from plastic or metal. Thus the weight of the sweeper 10 can thus be kept at a minimum for ease of maneuvering.

In an alternative embodiment, the sweeper head is triangular is shape. There are side brushes mounted along each of the sides, which replace the brushes 30, 32, 34, 36 and 38.

The side brushes extend substantially the entire length of the sides and are mounted for rotation just as the brushes 30–38 are mounted for rotation. Similarly the side brushes are driven by a motor and gear arrangement as in the preferred embodiment. There are also corner brushes places at each of the corners. There are two corner brushes on each side that sweep debris from the corners toward the center of their respective side brush. The corner brushes rotate in opposite directions so that they both direct debris toward the cent of the side roller. This allows the sweeper to pick up corner debris regardless if it moves in the forward or backward direction. In this configuration there are a total of six corner brushes, two for each side. The corner brushes are mechanically connected to the motor so that they are driven in unison with the side rollers.

Thus there has been provided a floor sweeper that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A floor sweeper comprising:

an elongated handle having opposite top and bottom ends;

a substantially rectangular sweeper head with a front, back, and opposite first and second sides mounted at the bottom of the elongated handle, a front roller mounted on the front for rotation in a first direction;

a rear roller mounted on the rear for rotation in a second direction opposite the first direction;

first and second side rollers mounted on the first and second sides respectively;

the front, rear and side rollers all having sweeping bristles mounted thereon;

at least one front corner brush mounted adjacent to the front and first side, the front corner brush mounted on a shaft for rotating in the same direction as the front roller, the front corner brush extending radially beneath the first side to sweep debris from under the first side toward the first side roller;

at least one rear corner brush mounted adjacent to the rear and first side, the rear corner brush mounted on a shaft for rotating in the same direction as the rear roller, the rear corner brush extending radially beneath the first side to sweep debris from under the first side toward the first side roller; and debris receiving means for receiving the debris swept by the rollers.

2. The floor sweeper of claim 1 and further comprising a pivotal mounting means for attaching the bottom end of the elongated handle to the sweeper head.

3. The floor sweeper of claim 2 wherein the pivotal mounting means is a universal joint allowing the elongated handle to pivot 360° about the universal joint.

4. The floor sweeper of claim 1 and further comprising drive means for providing rotative power to the front, rear, first and second side rollers, front corner brush and rear corner brush for rotating the rollers and brushes to sweep debris into the debris receiving means.

5. The floor sweeper of claim 4 wherein the drive means comprises an electric motor and power source to energize the electric motor, the electric motor connected to at least one of the front, rear, first and second side rollers, and the front, rear, first and second side rollers are all mechanically interconnected so that they rotate in unison.

6. The floor sweeper of claim 5 and further comprising mechanical connection means for mechanically connecting the front and rear corner brushes to the front and rear rollers respectively for rotating the front and rear corner brushes in unison with the front and rear rollers respectively.

7. The floor sweeper of claim 5 wherein the front, rear, first and second side rollers are mechanically interconnected by gears mounted on the front, rear and side rollers, the gear on one roller driving an engaging gear on an adjacent roller.

8. The floor sweeper of claim 7 wherein the gears mounted on the rollers drive the front roller in a first sweeping direction and the rear roller is driven in a second sweeping direction that is opposite the first sweeping direction.

9. The floor sweeper of claim 5 and further comprising an electric switch mounted in the elongated handle for turning the electric motor on and off.

10. The floor sweeper of claim 1 and further comprising a second front corner brush mounted adjacent to the front and second side, the second front corner brush mounted on a shaft for rotating in the same direction as the front roller, the second front corner brush extending radially beneath the second side to sweep debris from under the second side toward the second side roller, and a second rear corner brush mounted adjacent to the rear and second side, the rear corner brush mounted on a shaft for rotating in the same direction as the rear roller, the second rear corner brush extending radially beneath the second side to sweep debris from under the second side toward the second side roller.

11. The floor sweeper of claim 10 and further comprising second mechanical connection means for mechanically connecting the second front corner brush and second rear corner brush to the front and rear rollers respectively for rotating the second front corner brush and second rear brush in unison with the front and rear rollers respectively.

12. A floor sweeper for sweeping a surface comprising:

a sweeper head of substantially rectangular configuration having a top and bottom, a front side, a rear side, and first and second opposite sides, the first and second sides intersecting the front side and defining two front corners at the line of intersection, the first and second sides further intersecting the rear side and defining two rear corners at the line of intersection;

a front roller mounted at the front side;

a rear roller mounted at the rear side;

a first side roller mounted at the first side;

a second side roller mounted at the second side;

the front roller, rear roller, first and second side rollers all having sweeping bristles thereon;

debris receiving means mounted on the sweeper head for receiving debris swept by the bristles;

a front corner brush mounted at each of the two front corners, the front corner brushes having radially extending bristles that extend underneath the side adjacent to the front corner brush, the front corner brushes mounted for rotation, means for rotating the front roller and front corner brushes in a first sweeping direction;

the front corner brushes engaging the floor surface and sweeping debris from beneath the sides toward the side rollers;

means for rotating the side rollers in a sweeping direction to direct debris from the corner brushes and side brushes into the debris receiving means.

13. The floor sweeper of claim 12 and further comprising a rear corner brush mounted at each of the two rear corners, the rear corner brushes having radially extending bristles that extend underneath the side adjacent to the rear corner brush, the rear corner brushes mounted for rotation.

14. The floor sweeper of claim 13 and further comprising means for rotating the rear roller and the rear corner brushes in a second sweeping direction opposite the first sweeping direction.

15. The floor sweeper of claim 13 and further comprising drive means for providing rotative power to the front, rear, first and second side rollers, front corner brushes and rear corner brushes for rotating the rollers and brushes to sweep debris into the debris receiving means.

16. The floor sweeper of claim 15 wherein the drive means comprises an electric motor and power source to energize the electric motor, the electric motor connected to at least one of the front, rear, first and second side rollers, and the front, rear, first and second side rollers are all mechanically interconnected so that they rotate in unison.

17. The floor sweeper of claim 16 and further comprising mechanical connection means for mechanically connecting the front and rear corner brushes to the front and rear rollers respectively for rotating the front and rear corner brushes in unison with the front and rear rollers respectively.

18. The floor sweeper of claim 17 wherein the front, rear, first and second side rollers are mechanically interconnected by gears mounted on the front, rear and side rollers, the gear on one roller driving an engaging gear on an adjacent roller.

19. The floor sweeper of claim 12 wherein the debris receiving means comprises a removable debris receiving tray.

20. The floor sweeper of claim 12 and further comprising an elongated handle having opposite top and bottom ends, and attachment means for attaching the bottom end to the top of the sweeper head.

21. The floor sweeper of claim 20 and wherein the attachment means comprises a pivotal mounting means for attaching the bottom end of the elongated handle to the sweeper head.

22. The floor sweeper of claim 21 wherein the pivotal mounting means is a universal joint allowing the elongated handle to pivot 360° about the universal joint.

23. The floor sweeper of claim 12 and further comprising sliding means mounted to the bottom of the sweeper head for allowing the sweeper head to move on the surface.

24. A floor sweeper comprising:

an elongated handle having opposite top and bottom ends;

a sweeper head with at least a first, a second and a third side mounted at the bottom of the elongated handle, the three sides connected to each other in a triangular configuration to define three corners, one corner at each point of connection of a side to an adjacent side, a first side roller mounted on the first side for rotation in a first debris sweeping direction;

a second side roller mounted on the second side for rotation in a second debris sweeping direction;

a third side roller mounted on the third side for rotation in a third debris sweeping direction;

the first, second and third rollers each having first and second opposite ends, and all rollers having sweeping bristles mounted thereon;

a corner brush mounted on each side adjacent to each corner at opposite first and second ends of their respective side roller, the corner brushes mounted for rotating in opposite directions with respect to each other, each corner brush extending radially beneath the side to which it is mounted and rotating in a direction to sweep debris from under the side toward the center of its respective side roller, and debris receiving means mounted on the sweeper head for receiving the debris swept by the side rollers.

25. The floor sweeper of claim 24 and further comprising a pivotal mounting means for attaching the bottom end of the elongated handle to the sweeper head.

26. The floor sweeper of claim 24 and further comprising drive means for providing rotative power to the side rollers and corner brushes for rotating the rollers and brushes to sweep debris into the debris receiving means.

27. The floor sweeper of claim 26 wherein the drive means comprises an electric motor and power source to energize the electric motor, the electric motor connected to at least one of the side rollers, and the other side rollers are all mechanically interconnected so that they all rotate in unison.

28. A floor sweeper adapted to be moved horizontally in any direction over a surface and clean said surface by brushing, said sweeper comprising a head having a top and bottom, a handle extending from said top and connected to said head by a universal joint, a plurality of glides mounted on the bottom of the sweeper head, said glides permitting said head to engage said surface in a manner permitting relatively free movement of said head over said surface in any horizontal direction and said universal joint permitting the sweeper head relatively free movement with respect to the handle as the head freely moves over the surface in any horizontal direction, and a plurality of brushes moveably mounted on said head and extending therebelow so as to engage said surface, one of said brushes facing outwardly from said head in a first direction and another of said brushes facing outwardly from said head in a second direction different from but not opposite to said first direction, and moving means operatively connected to said brushes to cause them to move relative to said head.

29. The floor sweeper of claim 28, in which said brushes are mounted on said head so as to rotate.

30. The floor sweeper of claim 29, in which two adjacent brushes face outwardly in directions which define an angle therebetween having a vertex.

31. The floor sweeper of claim 28, in which said brushes are mounted on said head so as to rotate in a direction such as to tend to sweep debris into said head.

32. A floor sweeper adapted to be moved over a surface and clean said surface by brushing, said sweeper comprising a head having a plurality of brushes moveably mounted in said head for rotation and further mounted to extend therebelow so as to engage said surface, one of said brushes facing outwardly from said head in a first direction and another of said brushes facing outwardly from said head in a second direction different from but not opposite to said first direction, and moving means operatively connected to said brushes to cause them to move relative to said head in which two adjacent brushes face outwardly in directions which define an angle therebetween having a vertex, and in which an additional brush is mounted on said head generally at said vertex.

33. The floor sweeper of claim 32, and in which the additional brush is operatively connected to said moving means so as to move to sweep debris toward at least one of said adjacent brushes.

34. The floor sweeper of claim 32, in which a handle extends from said head and is connected to said head by a universal joint.

35. The floor sweeper of claim 34, in which said head engages said surface by means permitting relatively free movement of said head over said surface in a plurality of direction other than forward and back.

36. A floor sweeper adapted to be moved over a surface and clean that surface by brushing, said sweeper comprising a head having a periphery and an under surface, a handle extending from said head and connected to said head by a universal joint, a plurality of glides mounted on the under surface of the sweeper head, said glides permitting said head to engage said surface by permitting relatively free movement of said head over said surface in a plurality of directions other than forward and back and said universal joint permitting the sweeper head relatively free movement with respect to the handle as the head freely moves over the surface in the plurality of directions, a plurality of brushes moveably mounted on said head to extend therebelow so as to engage said surface, said brushes being rotatable about non-parallel axes angularly related to one another, and moving means operatively connected to said brushes to cause them to rotate about their axes.

37. The floor sweeper of claim 36, in which the brushes rotate in directions such as to tend to sweep debris into said head.

38. The floor sweeper of claim 37, in which two adjacent brushes are mounted on said head to rotate about axes which define an angle therebetween producing a vertex, and in which an additional brush is mounted on said head generally at said vertex.

39. The floor sweeper of claim 37, in which two adjacent brushes are mounted on said head to rotate about axes which define an angle therebetween producing a vertex, and in which an additional brush is mounted on said head generally at said vertex, and operatively connected to said moving means so as to tend to sweep debris toward at least one of said adjacent brushes.

* * * * *